US009577342B2

(12) United States Patent
Manasson et al.

(10) Patent No.: US 9,577,342 B2
(45) Date of Patent: Feb. 21, 2017

(54) PLANAR DIELECTRIC WAVEGUIDE WITH METAL GRID FOR ANTENNA APPLICATIONS

(75) Inventors: Vladimir Manasson, Irvine, CA (US); Victor Khodos, Torrance, CA (US); Lev Sadovnik, Irvine, CA (US); Aramais Avakian, Pasadena, CA (US); Vladimir Litvinov, Aliso Viejo, CA (US); Dexin Jia, Irvine, CA (US); Mikhail Felman, Tarzana, CA (US); Mark Aretskin, Irvine, CA (US)

(73) Assignee: SIERRA NEVADA CORPORATION, Sparks, NV (US)

( * ) Notice: Subject to any disclaimer, the term of this patent is extended or adjusted under 35 U.S.C. 154(b) by 27 days.

(21) Appl. No.: 13/291,911

(22) Filed: Nov. 8, 2011

(65) Prior Publication Data

US 2012/0056794 A1 Mar. 8, 2012

Related U.S. Application Data

(63) Continuation of application No. 12/168,728, filed on Jul. 7, 2008, now Pat. No. 8,059,051.

(51) Int. Cl.

| | |
|---|---|
| ***H01Q 13/00*** | (2006.01) |
| ***H01Q 13/28*** | (2006.01) |
| ***H01Q 3/20*** | (2006.01) |

(52) U.S. Cl.

CPC ..... *H01Q 13/28* (2013.01); *H01Q 3/20* (2013.01)

(58) Field of Classification Search

USPC ..... 343/785

See application file for complete search history.

(56) References Cited

U.S. PATENT DOCUMENTS

| | | | |
|---|---|---|---|
| 3,508,265 | A | 4/1970 | Ellis |
| 5,572,228 | A | 11/1996 | Manasson et al. |
| 5,815,124 | A | 9/1998 | Manasson et al. |
| 5,886,670 | A | 3/1999 | Manasson et al. |
| 5,982,334 | A | 11/1999 | Manasson et al. |
| 6,127,987 | A | 10/2000 | Maruyama et al. |
| 6,211,836 | B1 | 4/2001 | Manasson et al. |
| 6,229,488 | B1 | 5/2001 | Lin et al. |
| 6,313,803 | B1 | 11/2001 | Manasson et al. |
| 6,317,095 | B1 | 11/2001 | Teshirogi et al. |
| 6,587,076 | B2 | 7/2003 | Fujii et al. |

(Continued)

FOREIGN PATENT DOCUMENTS

| | | |
|---|---|---|
| DE | 10 2004 049 626 | 6/2006 |
| EP | 1130680 | 9/2001 |
| EP | 1717903 | 11/2006 |

OTHER PUBLICATIONS

International Search Report on corresponding PCT application (PCT/US2008/086654) from International Searching Authority (KIPO) dated Jun. 29, 2009.

Written Opinion on corresponding PCT application (PCT/US2008/086654) from International Searching Authority (KIPO) dated Jun. 29, 2009.

(Continued)

*Primary Examiner* — Graham Smith

(74) *Attorney, Agent, or Firm* — Klein, O'Neill & Singh, LLP

(57) ABSTRACT

A waveguide includes a dielectric substrate having first and second opposed surfaces defining a longitudinal wave propagation path therebetween; and a conductive grid on the first surface of the substrate and comprising a plurality of substantially parallel metal strips, each defining an axis. The grid renders the first surface of the substrate opaque to a longitudinal electromagnetic wave propagating along the longitudinal wave propagation path and polarized in a direction substantially parallel to the axes of the strips. The grid allows the first surface of the substrate to be transparent to a transverse electromagnetic wave having a transverse propagation path that intersects the first and second surfaces of the substrate and having a polarization in a direction substantially normal to the plurality of metal strips. A diffraction grating on the second surface allows the waveguide to function as an antenna element that may be employed in a beam-steering antenna system.

13 Claims, 4 Drawing Sheets

(56) References Cited

U.S. PATENT DOCUMENTS

| | | | | |
|---|---|---|---|---|
| 6,737,938 | B2 | 5/2004 | Kitamori et al. | |
| 6,750,827 | B2 | 6/2004 | Manasson et al. | |
| 7,071,888 | B2 | 7/2006 | Sievenpiper | |
| 7,151,499 | B2 | 12/2006 | Avakian et al. | |
| 7,205,862 | B2 | 4/2007 | Tahara et al. | |
| 7,394,427 | B2 | 7/2008 | Cho et al. | |
| 7,683,982 | B2 * | 3/2010 | Cho | 349/96 |
| 2002/0080065 | A1 | 6/2002 | Fujii et al. | |
| 2007/0046525 | A1 * | 3/2007 | Holbrook et al. | 342/22 |

OTHER PUBLICATIONS

International Search Report on corresponding PCT application (PCT/US2009/046998) from International Searching Authority (KIPO) dated Jan. 27, 2010.

Written Opinion on corresponding PCT application (PCT/US2009/046998) from International Searching Authority (KIPO) dated Jan. 27, 2010.

European Search Report on corresponding EP application (EP09794878.0) from European Patent Office (EPO) dated Dec. 20, 2012.

Chen et al.; "FDTD Analysis of a Metal-Strip-Loaded Dielectric Leaky-Wave Antenna"; IEEE Transactions on Antennas and Propagation, IEEE Service Center, Piscataway, NJ, US; vol. 45, No. 8; Aug. 1, 1997; XP011003028.

Ziolkowski; "The Incorporation of Microscopic Material Models into the FDTD Approach for Ultrafast Optical Pulse Simulations"; IEEE Transactions on Antennas and Propagation, IEEE Service Center, Piscataway, NJ, US; vol. 45, No. 3; Mar. 1, 1997; XP011002939.

* cited by examiner

PLANAR DIELECTRIC WAVEGUIDE WITH METAL GRID FOR ANTENNA APPLICATIONS

CROSS-REFERENCE TO RELATED APPLICATION

The present application is a continuation of U.S. patent application Ser. No. 12/168,728, filed Jul. 7, 2008, entitled PLANAR DIELECTRIC WAVEGUIDE WITH METAL GRID FOR ANTENNA APPLICATIONS, issuing as U.S. Pat. No. 8,059,051, the disclosure of which is hereby incorporated by reference as if set forth in full herein.

FEDERALLY SPONSORED RESEARCH OR DEVELOPMENT

Not Applicable

BACKGROUND OF THE INVENTION

The present disclosure relates generally to the field of waveguides that permit transmission or reception of electromagnetic radiation (particularly millimeter wavelength radiation) with certain characteristics in selective directions while not substantially impacting the transmission and reception of electromagnetic radiation with different characteristics. This disclosure further relates to the use of such waveguides in antenna applications.

Dielectric waveguide antennas are well-known in the art, as exemplified by U.S. Pat. No. 6,750,827; U.S. Pat. No. 6,211,836; U.S. Pat. No. 5,815,124; and U.S. Pat. No. 5,959,589, the disclosures of which are incorporated herein by reference. Such antennas operate by the evanescent coupling of electromagnetic waves out of an elongate (typically rod-like) dielectric waveguide to a rotating cylinder or drum, and then radiating the coupled electromagnetic energy in directions determined by surface features of the drum. By defining rows of features, wherein the features of each row have a different period, and by rotating the drum around an axis that is parallel to that of the waveguide, the radiation can be directed in a plane over an angular range determined by the different periods.

Scanning or beam-steering antennas, particularly dielectric waveguide antennas, are used to send and receive steerable millimeter wave electromagnetic beams in various types of communication applications, and in radar devices, such as collision avoidance radars. In such antennas, an antenna element includes an evanescent coupling portion having a selectively variable coupling geometry. A transmission line, such as a dielectric waveguide, is disposed closely adjacent to the coupling portion so as to permit evanescent coupling of an electromagnetic wave between the transmission line and the antenna elements, whereby electromagnetic radiation is transmitted or received by the antenna. The shape and direction of the transmitted or received beam are determined by the coupling geometry of the coupling portion. By controllably varying the coupling geometry, the shape and direction of the transmitted/received beam may be correspondingly varied.

It is well known to construct a dielectric waveguide to contain the propagation of an electromagnetic wave in a given direction. For example, a waveguide with a dielectric substrate or slab and a metal plate disposed adjacent the dielectric slab will prevent any leakage of the electromagnetic wave through the metal plate, while permitting the electromagnetic wave to travel, for example, along the plane of the dielectric slab. However, the metal plate will also prevent the passage of other electromagnetic waves through it, for example, an electromagnetic wave that may be incident on the metal plate at an angle.

When multiple, steerable or beam steering antennas are used in close proximity, the waveguide described above may obstruct the passage of other electromagnetic waves that are traveling in a direction that crosses the waveguide's metal plate. Therefore, there is a need for a waveguide that permits transmission or reception of electromagnetic radiation with certain characteristic in selective directions without substantially impacting the transmission and reception of electromagnetic radiation with different characteristics.

SUMMARY OF THE INVENTION

Broadly, a first aspect of the present disclosure is a planar dielectric waveguide, operable for both transmission and reception of electromagnetic radiation (particularly microwave and millimeter wavelength radiation). The dielectric waveguide comprises a dielectric substrate or slab having first and second opposed surfaces defining a longitudinal wave propagation path therebetween; and a metallized conductive grid on the first surface, the grid comprising a plurality of substantially parallel conductive metal waveguide strips, each defining an axis transverse to the longitudinal path, whereby the grid renders the first surface substantially opaque to a longitudinal electromagnetic wave polarized in a direction substantially parallel to the axes of the metal waveguide strips and having a propagation direction substantially along the longitudinal wave propagation path and thus substantially normal to the axes of the strips. The conductive grid, however, is substantially transparent to a transverse electromagnetic wave polarized in a direction substantially normal to the axes of the waveguide strips and having a propagation path that intersects the first and second surfaces of the slab or substrate.

In accordance with another aspect of the present disclosure, a leaky waveguide antenna includes a dielectric waveguide constructed as described above. The leaky waveguide antenna includes a diffraction grating on the surface of the dielectric slab opposite the conductive grid, whereby an electromagnetic wave propagating longitudinally through the slab is diffracted out of the plane of the slab. Optionally, the antenna may include a reflector configured to reflect the electromagnetic wave diffracted from the dielectric slab back toward the dielectric slab with a polarization substantially normal the axes of the metal strips, whereby the waveguide is transparent to the reflected electromagnetic wave.

As will be more readily appreciated from the detailed description that follows, the present disclosure provides a waveguide that permits transmission or reception of electromagnetic radiation with certain characteristic in selective directions without substantially impacting the transmission and reception of electromagnetic radiation with different characteristics.

DETAILED DESCRIPTION OF THE INVENTION

Figure 1:
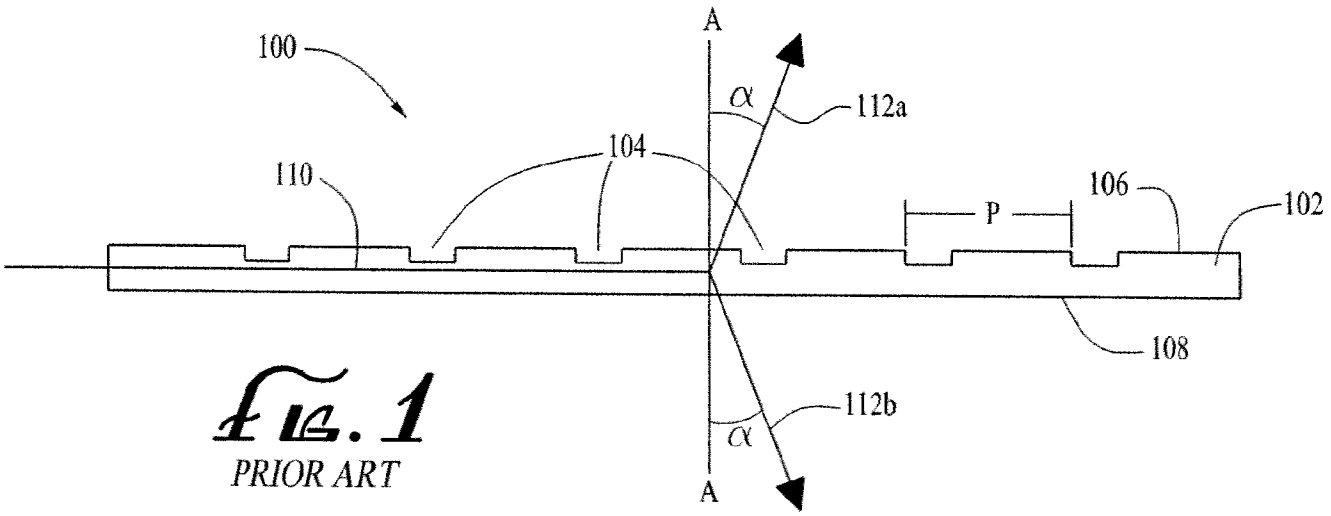
FIG. 1 PRIOR ART
FIG. 1 is a semi-diagrammatic elevational view of a conventional leaky waveguide antenna, known in the prior art.

FIG. 1 illustrates a leaky waveguide antenna 100, of a conventional type well known in the art. The leaky waveguide antenna 100 includes a dielectric substrate or slab 102, with a top surface 106 and bottom surface 108. A diffraction grating comprising a plurality of diffraction grating scattering elements 104 is provided on the top surface 106 of the dielectric slab 102. A longitudinal electromagnetic wave propagates through the dielectric slab 102, between the top surface 106 and bottom surface 108, along a longitudinal propagation path 110. Based upon the characteristics of the leaky waveguide antenna 100, the longitudinal wave is diffracted and radiates out of the dielectric slab 102 in two directions, along a first or forward diffracted path 112*a* and a second or backward diffracted path 112*b*, at a beam angle $\alpha$, measured with reference to a line A-A perpendicular to the propagation path 110, prior to the radiation. The beam angle $\alpha$ is given by the formula: $\sin \alpha = \beta/k - \lambda/P$, where $\beta$ is the wave propagation constant in the waveguide 100, k is the wave vector in a vacuum, $\lambda$ is the wavelength of the electromagnetic wave propagating through the substrate or slab 102, and P is the period of the diffraction grating. The beam angle $\alpha$ may be positive or negative, relative to the reference line A-A, based upon the characteristics of the antenna 100.

By varying the period P of the diffraction grating, the beam angle $\alpha$ may be varied to provide a steerable beam. Also, the backward diffracted path 112*b* may be suppressed or greatly attenuated by making the waveguide opaque (or nearly so) to the electromagnetic wave on the dielectric slab surface opposite the diffraction grating (i.e., the bottom surface 108 in FIG. 1). This result is typically achieved by providing a conductive metal layer (not shown) on the bottom surface 108. One drawback to this design, however, is that the antenna 100 is not "transparent" to radiation that may be coupled to waveguide from a neighboring antenna, and thus such "stray" radiation may interfere with the desired steerable beam. From the description that follows, it will be appreciated that one advantageous aspect of the waveguide and antenna of the present disclosure is that it is transparent to such stray radiation, thereby minimizing the degree of interference caused thereby.

Figure 3A:
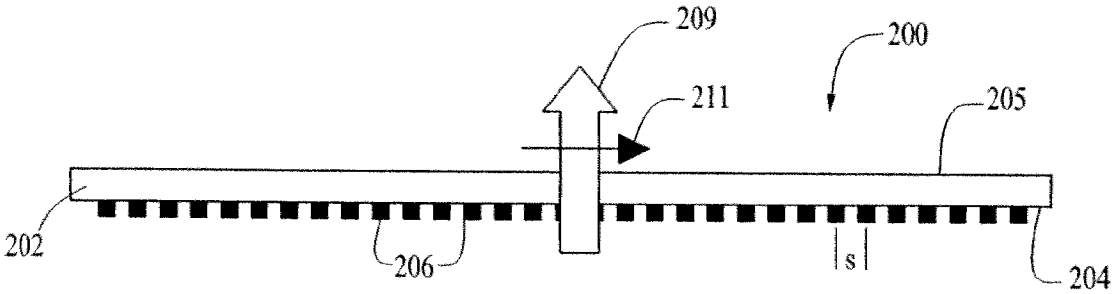
FIG. 3A is a semi-diagrammatic elevational view of the dielectric waveguide of FIG. 2.
Figure 2:
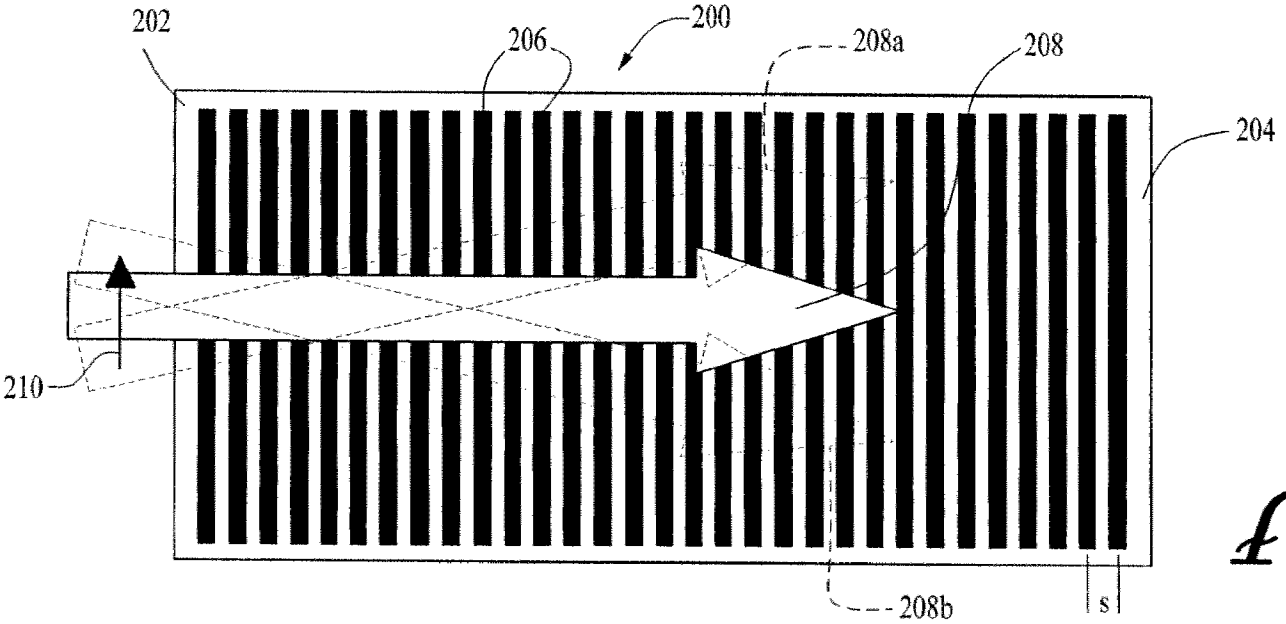
FIG. 2 is a semi-diagrammatic bottom plan view of a dielectric waveguide of the present disclosure.

Referring to FIGS. 2 and 3A, a dielectric waveguide 200 of the present disclosure includes a dielectric substrate or slab 202 having a first or bottom surface 204 and a second or top surface 205 defining a longitudinal wave path 208 therebetween. A conductive grid of substantially parallel metal strips 206 is applied to or formed on one surface (e.g., the bottom surface 204) by any appropriate method known in the art, such as, for example, by deposition of a metal layer followed by photolithography (photo-resist masking and chemical etching of the metal layer), or by metal deposition through a mask. The spacing s between the centers of any two adjacent metal strips 206 meets the condition whereby $s<\lambda/(1+\beta/k)$, and preferably $s\approx\lambda/10$ (the parameters being defined above). The metal strips 206 are arranged with axes that are substantially perpendicular or normal to the longitudinal path 208, which is the propagation path of a first, longitudinal electromagnetic wave within the dielectric slab 202. It will be appreciated that the longitudinal wave may vary somewhat from a path that is normal to the metal strips 206, and thus may propagate along an alternate nearly longitudinal path 208*a*, 208*b* that may deviate somewhat from 90° with respect to the orientation of the metal strips 206. Thus, the waveguide 200 will support propagation of an electromagnetic wave along a first (longitudinal) propagation path 208, 208*a*, 208*b* that is preferably substantially normal to the axes of the metal strips 206.

If the longitudinal wave is polarized in a direction that is substantially parallel to the axes of the metal strips 206, as indicated by the arrow 210 in FIG. 2, the grid of strips 206 will make the bottom surface of the dielectric slab 202 substantially opaque to the longitudinally-propagating wave, and thus will substantially prevent the longitudinally-propagating electromagnetic wave from penetrating through the grid of metal strips 206 and thus through the plane defined by the slab or substrate 202 of the waveguide 200. In this manner, the waveguide 200 prevents the longitudinal wave from penetrating the first (bottom) surface 204 of the dielectric substrate 202.

As shown in FIG. 3A, the waveguide 200 permits the propagation of a second, or transverse, electromagnetic wave along a second or transverse propagation path 209 that intersects the first and second surfaces of the slab or substrate 202 of the waveguide 200, provided that the second or transverse wave is polarized in a direction that is substantially orthogonal or normal to the axes of the metal strips 206, as indicated by the arrow 211 in FIG. 3A. This transverse electromagnetic wave may thus pass through the waveguide 200, either in a direction from the bottom slab surface 204 toward the top slab surface 205, as shown in FIG. 3A, or in the opposite direction (i.e., from the top slab surface 205 toward the bottom slab surface 204), because the grid of metal strips 206 allows the bottom surface 204 of the substrate or slab 202 to be substantially transparent to an electromagnetic wave having the propagation path and polarization direction of the above-described transverse wave. In practice, the propagation path 209 of the second or transverse wave may be substantially perpendicular to the plane defined by the slab 202, although the waveguide may be sufficiently transparent to a wave having a propagation path 209 that deviates measurably from a perpendicular (90°) angle of incidence to provide the required result.

Figure 3B:
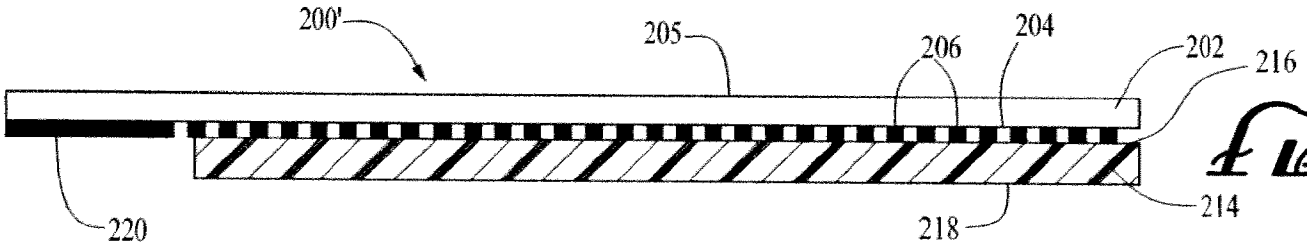
FIG. 3B is a semi-diagrammatic elevational view of a modified form of the waveguide of FIG. 2.

FIG. 3B shows a waveguide 200' that is a modification of the above-described waveguide 200 shown in FIGS. 2 and 3A. It is often required that the waveguide support only a single propagation mode. For example, in leaky waveguide antennas, single mode propagation is a necessary condition for the antenna to transmit/receive a single beam. This condition can be achieved by restricting the relevant waveguide dimension, which, in this case, is thickness. Thus, to provide single mode operation, the thickness of the dielectric slab 202 of the waveguide 200 needs to be sufficiently small to provide a cut-off for the second mode. Such a thin waveguide may lack sufficient structural robustness for many applications. To provide additional structural rigidity to the waveguide, a dielectric reinforcing plate 214 is provided under the grid of metal strips 206. The dielectric reinforcing plate 214 thus has a top surface 216 and a bottom surface 218, wherein the top surface 216 is in contact with the grid of metal strips 206. Due to the screening effect of the metal strips 206, the dielectric reinforcing plate 214 does not couple electromagnetically to the waveguide 202. Thus, the function and operation of the modified waveguide 200' are not affected by the dielectric reinforcing plate 214, and they are substantially as described above with respect to FIGS. 2 and 3A.

The thickness of the dielectric reinforcing plate 214 may be empirically selected to support anti-reflective conditions for the transverse electromagnetic wave propagating along the transverse propagation path 209 shown in FIG. 3A. The thickness selected depends on such factors as the wavelength of the electromagnetic radiation, the optical characteristics of the particular material used for the reinforcing plate 214, the optical thickness of the waveguide 202, and the spacing s between the metal strips 206. These anti-reflective conditions may also be optimized by selecting an appropriate multi-layered structure for the dielectric reinforcing plate 214, in accordance with known anti-reflection optimization techniques.

The waveguide described with reference to FIGS. 2, 3A and 3B may be used to create a leaky waveguide antenna by adding a suitable diffraction grating to the dielectric substrate or slab, on the surface opposite the conductive grid. The diffraction grating may be made as a set of periodic or quasi-periodic grooves, metal strips, metal patches, or other scattering elements. One embodiment of a leaky waveguide antenna with a diffraction grating made of a plurality of grooves is shown in FIG. 4, and another embodiment, with a diffraction grating made of a plurality of metal strips, is shown in FIG. 5.

Figure 4:
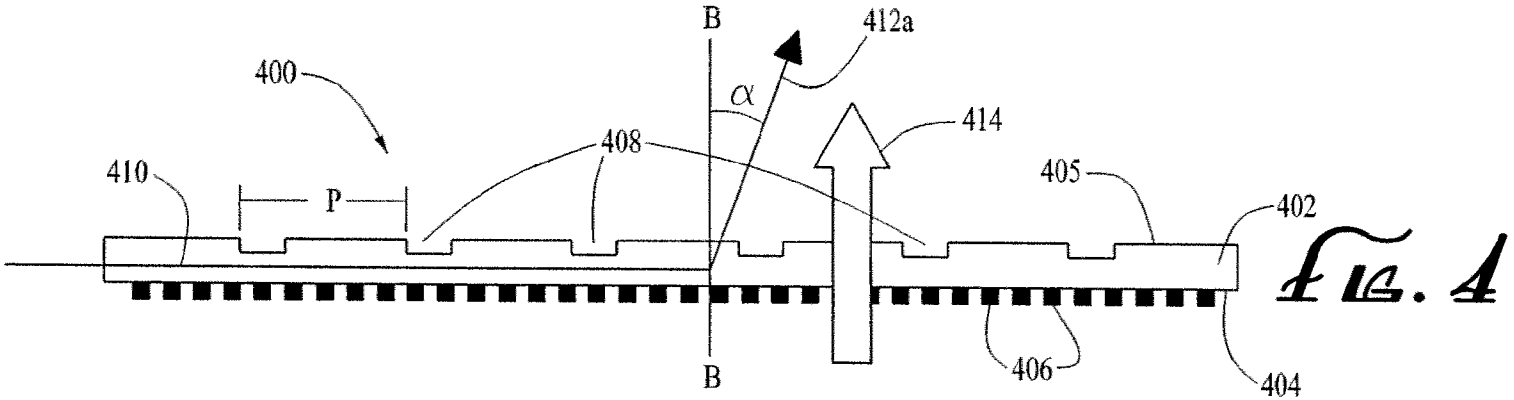
FIG. 4 is semi-diagrammatic elevational view of one embodiment of a leaky waveguide antenna of the present disclosure.
Figure 5:
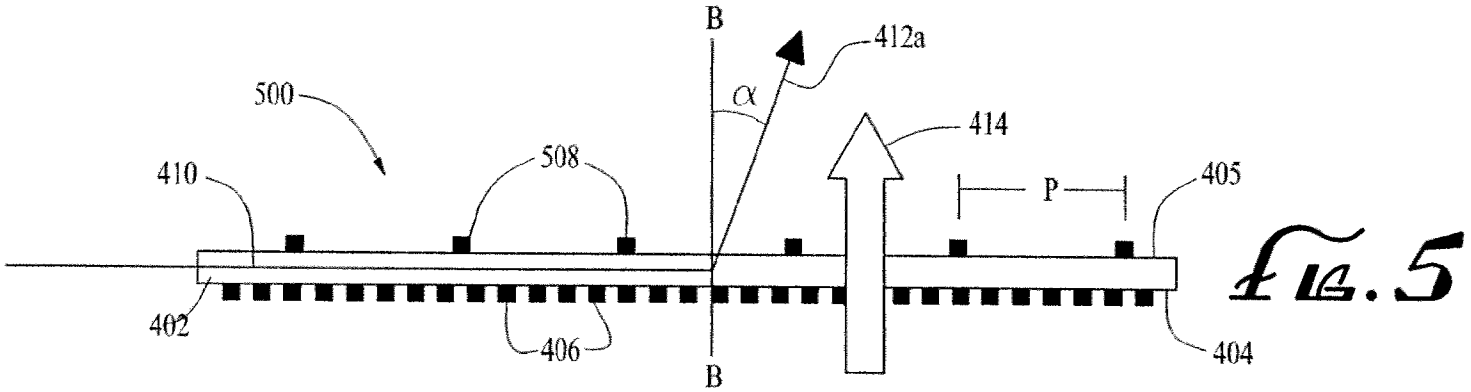
FIG. 5 is a semi-diagrammatic elevational view of another embodiment of a leaky waveguide antenna of the present disclosure.

Referring to FIG. 4, a leaky waveguide antenna 400 includes a waveguide comprising a dielectric substrate or slab 402, with a first or bottom surface 404 and a second or top surface 405, and a conductive grid, comprising a plurality of substantially parallel metal strips 406, disposed on the bottom surface 404. The waveguide antenna 400 further comprises a diffraction grating, having a period P, provided by a periodic or quasi-periodic pattern of grooves 408 formed in the top surface 405 of the dielectric slab 402. A first or longitudinal electromagnetic wave travels along the length of the dielectric slab 402, substantially along a longitudinal incident propagation path 410, between the top surface 405 and bottom surface 404. Based upon the characteristics of the leaky waveguide antenna 400, the first electromagnetic wave is diffracted out of the dielectric slab 402 as a diffracted electromagnetic wave, substantially along a diffracted propagation path 412*a*, at a beam angle $\alpha$, measured with reference to a line B-B that is perpendicular to the incident propagation path 410. The beam angle $\alpha$ is given by the formula: $\sin \alpha=\beta/k-\lambda/P$, where $\beta$ is the wave propagation constant in the waveguide antenna 400, k is the wave vector in a vacuum, $\lambda$ is the wavelength of the electromagnetic radiation propagating through the dielectric slab 402, and P is the period of the diffraction grating grooves 408. The beam angle $\alpha$ may be positive or negative, based upon the value of the parameters in the above-mentioned formula. The beam path analogous to the beam path 112*b* in FIG. 1 (that is, the diffracted beam path extending through the plane of the dielectric slab 402) is effectively suppressed by the grid of metal strips 406, so that only a single beam is radiated along the diffracted propagation path 412*a*.

As previously described with respect to FIGS. 2, 3A, and 3B, the spacing s between the centers of any two adjacent metal strips 406 meets the condition whereby $s<\lambda/(1+\beta/k)$, and preferably $s\approx\lambda/10$ (the parameters being defined above). The metal strips 406 are arranged transversely across the bottom surface of the dielectric substrate 402, with axes perpendicular or normal to the longitudinal incident propagation path 410 of the first or longitudinal electromagnetic wave. It will be appreciated that the first electromagnetic wave may vary somewhat from a path that is normal to the metal strips 410, and thus may propagate along an alternate path that deviates somewhat from 90° with respect to the orientation of the metal strips 406, as discussed above with reference to FIG. 2. Thus, the antenna 400 will support propagation of a longitudinal electromagnetic wave along a first, substantially longitudinal propagation path 410 within the dielectric slab 402 that is preferably substantially normal to the metal strips 406. As discussed above with reference to FIGS. 2 and 3A, if the longitudinal wave is polarized in a direction that is substantially parallel to the axes of the metal strips 406, the longitudinal wave will be prevented from taking a diffracted path that penetrates through the grid of metal strips 406.

The antenna 400 permits the propagation of a second or transverse electromagnetic wave along a second propagation path 414 that intersects (and is preferably substantially perpendicular to) the first and second surfaces of the dielectric slab or substrate 402, provided that the second wave is polarized along a second polarization axis that is substantially orthogonal or normal to the orientation of the metal strips 406. This second or transverse electromagnetic wave may thus pass transversely through the thickness of the substrate or slab 402, either in a direction from the bottom slab surface 404 toward the top slab surface 405, as shown in FIG. 4, or in the opposite direction (i.e., from the top slab surface 405 toward the bottom slab surface 404).

Optionally, although not shown in FIG. 4, a dielectric plate, similar to the dielectric plate 214 shown in FIG. 3B, may be disposed in contact with the grid of metal strips 406 to provide additional structural rigidity to the leaky waveguide antenna 400. The leaky waveguide antenna 400 may optionally be coupled to an imaging waveguide element similar to the imaging waveguide 220 element shown in FIG. 3B, to receive and couple an electromagnetic wave to the leaky waveguide antenna 400. The imaging waveguide element may operate as a feed to the leaky waveguide antenna 400.

The leaky waveguide antenna 500 of FIG. 5 is substantially similar in structure and operation to the leaky waveguide antenna 400 described with respect to FIG. 4, except that the diffraction grating is provided by a second plurality of substantially parallel metal strips 508 formed on or applied to the top surface 405 of the dielectric substrate or slab 402. The strips 508 are advantageously formed by any of the methods described above for the formation of the first plurality of metal strips 406 on the bottom surface 404 of the dielectric substrate 402, and they are spaced so as to provide a diffraction grating with a period P. Functionally, the antenna 500 of FIG. 5 is substantially identical to the antenna 400 of FIG. 4, as described above.

Figure 6:
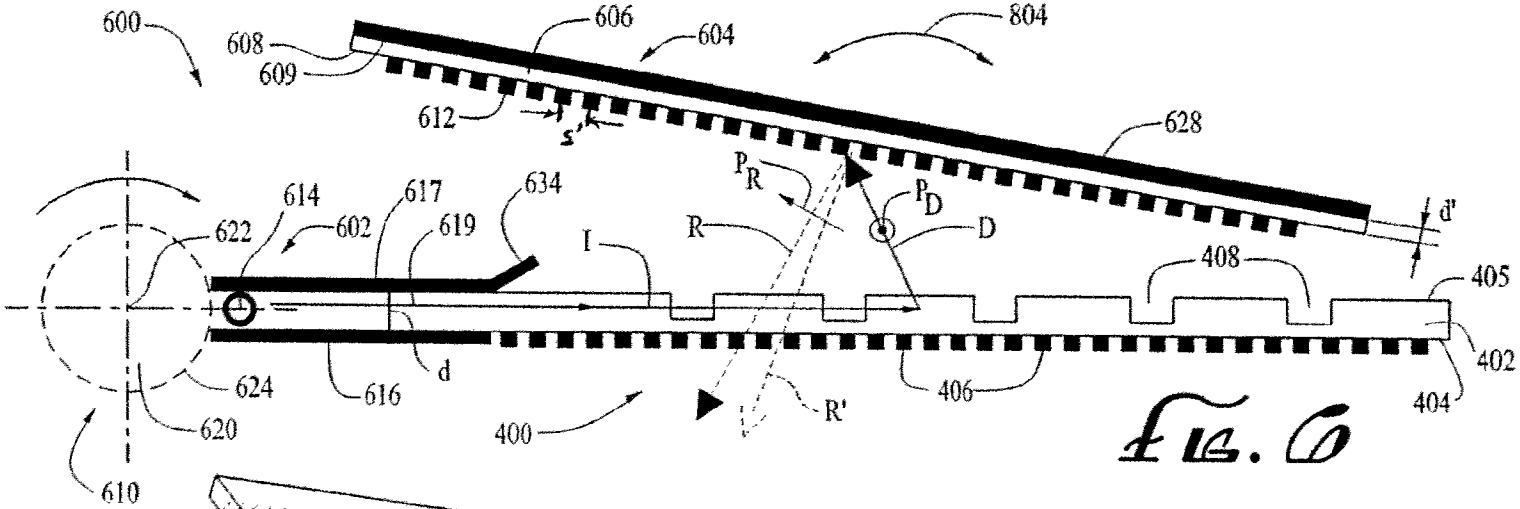
FIG. 6 is a semi-diagrammatic elevational view of a steerable antenna system of the present disclosure.
Figure 7:
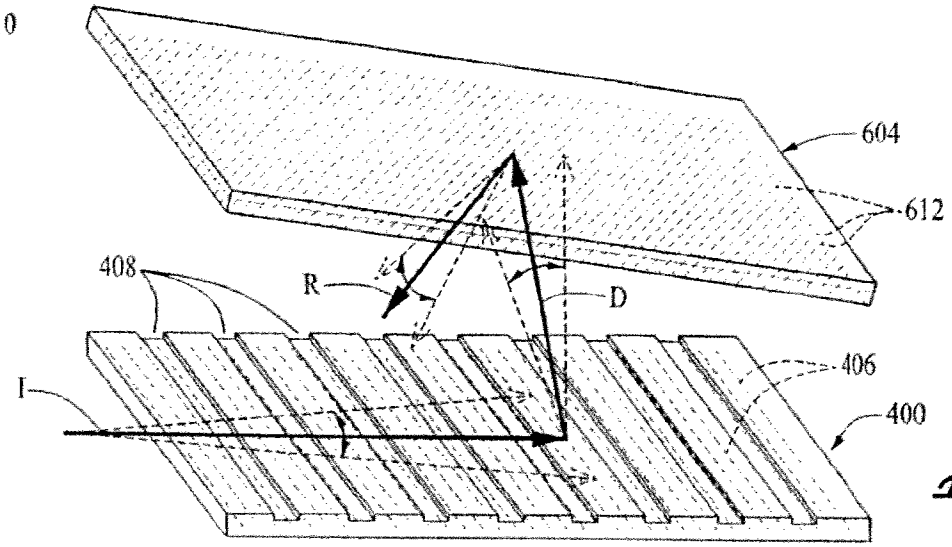
FIG. 7 is a perspective view of portions of the steerable antenna system of FIG. 6.

The leaky waveguide antenna described with reference to FIGS. 4 and 5 may be used to create one dimensional and two dimensional beam-steering antenna systems. Referring to FIGS. 6 and 7, a beam-steering antenna system 600 includes a dielectric waveguide antenna element (shown as the dielectric waveguide antenna 400, as described above with reference to FIG. 4, but which may, as an alternative, be the waveguide dielectric antenna 500 described above with reference to FIG. 5), and an antenna subsystem 602 to generate or receive electromagnetic waves for propagation through the dielectric waveguide antenna element 400. The antenna subsystem 602 comprises a scanning antenna element 610, a dielectric transmission line 614 evanescently coupled to the scanning antenna element 610, and lower and upper conductive waveguide plates 616, 617, respectively, that are operatively coupled between the transmission line 614 and the dielectric waveguide antenna element 400. The transmission line 614 is preferably an elongate, rod-shaped dielectric waveguide element with a circular cross-section, as shown. Dielectric waveguide transmission lines with other configurations, such as rectangular or square in cross-section, may also be employed. The scanning antenna element 610, in this embodiment, includes a drum or cylinder 620 that is rotated by conventional electromechanical means (not shown) around a rotational axis passing through the center 622 of the cylinder 620 that may be, but is not necessarily, parallel to the axis of the transmission line 614. Indeed, it may be advantageous for the rotational axis of the cylinder 622 to be skewed relative to the transmission line axis, as taught, for example, in above-mentioned U.S. Pat. No. 5,572,228, the disclosure of which is incorporated herein by reference. To prevent leakage of electromagnetic radiation via gaps between the plates 616, 617 and the scanning antenna element 610, the polarization of the electromagnetic wave supported by the waveguide assembly 614, 616, 617 is advantageously such that the electric field component is preferably in a plane that is parallel to the planes defined by the plates 616, 617, as indicated by the line 619. Any gaps between the plates 616, 617 and the scanning antenna element 610 should preferably be less than one-half the wavelength of the transmitted/received radiation in the propagation medium (e.g., air).

The drum or cylinder 620 may advantageously be any of the types disclosed in detail in, for example, the above-mentioned U.S. Pat. No. 5,572,228; U.S. Pat. No. 6,211,836; and U.S. Pat. No. 6,750,827, the disclosures of which are incorporated herein by reference. Briefly, the drum or cylinder 620 has an evanescent coupling portion located with respect to the transmission line 614 so as to permit evanescent coupling of electromagnetic waves between the coupling portion and the transmission line 614. The evanescent coupling portion has a selectively variable coupling geometry, which advantageously may take the form of a conductive metal diffraction grating 624 having a period $\Lambda$ that varies in a known manner along the circumference of the drum or cylinder 620. Alternatively, several discrete diffraction gratings 624, each with a different period $\Lambda$, may be disposed at spaced intervals around the circumference of the drum or cylinder 620. As taught, for example, in the aforementioned U.S. Pat. No. 5,572,228, the angular direction of the transmitted or received beam relative to the transmission line 614 is determined by the value of $\Lambda$ in a known way. The diffraction grating 624 may either be a part of a single, variable-period diffraction grating, or one of several discrete diffraction gratings, each with a distinct period $\Lambda$. In either case, the diffraction grating 624 is provided on the outer circumferential surface of the drum or cylinder 620. Specifically, the grating 624 may be formed on or fixed to the outer surface of a rigid substrate (not shown), which may be an integral part of the drum or cylinder 620.

The conductive waveguide plates 616, 617 are respectively disposed on opposite sides of the transmission line 614, each of the plates 616, 617 defining a plane that is substantially parallel to the axis of the transmission line 614. Each of the plates 616, 617 has a proximal end adjacent the antenna element 612, and a distal end remote from the scanning antenna element 610. The plates 616, 617 are separated by a separation distance d that is less than the wavelength $\lambda$ of the electromagnetic wave in the propagation medium (e.g., air), and greater than $\lambda/2$ to allow the electromagnetic wave with the above-described polarization to propagate between the conductive plates 616, 617. The arrangement of the transmission line 614, the scanning antenna element 610, and the conductive waveguide plates 616, 617 assures that the electromagnetic wave coupled between the transmission line 614 and the scanning antenna element 610 is confined to the space between the waveguide plates 616, 617, thereby effectively limiting the beam propagated as a result of the evanescent coupling to two dimensions, i.e., a single selected plane parallel to the planes defined by the conductive plates 616, 617. Thus, beam-shaping or steering is substantially limited to that selected plane, which may, for example, be the azimuth plane.

As shown in FIG. 6, the distal end of one of the plates 616, 617 (here shown as the upper plate 617) may be bent or turned outwardly from the plane of the plates at an angle relative to that plane, thereby forming a horn element 634 for matching the impedance of the parallel plate waveguide formed by the plates 616, 617 with the impedance of the dielectric waveguide antenna element 400.

The conductive waveguide plates 616, 617 are coupled to the dielectric waveguide element 400, which is advantageously both structurally and functionally similar to the leaky waveguide antenna described above with respect to FIG. 4, with a plurality of grooves 408 acting as a diffraction grating. In an alternate embodiment, as mentioned above, the dielectric waveguide antenna element may be the above-described dielectric waveguide element 500, shown in FIG. 5, that includes a second grid of metal strips acting as a diffraction grating. For the purposes of further description of the steering antenna system 600 and the leaky waveguide antenna 400, reference numerals used to describe various elements of the leaky waveguide antenna 400 in FIG. 4 will be used in FIGS. 6 and 7.

The period P of the diffraction grating, (e.g., the plurality of grooves 408) is selected so as to radiate a diffracted electromagnetic wave out of the plane of the waveguide antenna 400 at a selected diffraction angle with respect to the direction of propagation of the electromagnetic wave prior to the radiation; for example, in a direction indicated by the arrow D. Preferably, the diffracted wave may have a horizontal polarization that is substantially parallel to the axis of the metal waveguide strips 406.

The above-described antenna system 600 provides beam steering or scanning in one plane (e.g., azimuth). Scanning or steering in two orthogonal planes (azimuth and elevation) may be accomplished by providing a reflector 604, as shown in FIGS. 6 and 7. The reflector 604 includes a dielectric layer 606 with a bottom surface 608 and a top surface 609, a conductive reflector grid comprising a plurality of substantially parallel metal reflector strips 612 disposed on the bottom surface 608 of the dielectric layer 606, and a metal plate 628 disposed on the top surface 609 of the dielectric layer 606. The thickness of the dielectric layer 606 d' is advantageously chosen to be about a quarter wavelength of the electromagnetic wave in the dielectric layer 606. As best shown in FIG. 7, the metal reflector strips 612 are advantageously oriented at an angle of about 45 degrees relative to the metal waveguide strips 406, with a spacing distance s' between adjacent reflector strips 612 given by the formula: $s' < \lambda/(1+\beta'/k)$, where $\beta'$ is the propagation constant in the reflector structure comprising the dielectric layer 606, the metal plate 628, and the grid of conductive strips 612, and where the other parameters are as defined above. The spacing s' must be sufficiently small to prevent such coupling of the incident wave into the structure of the reflector 604 as make the reflector into a "parasitic" waveguide that may extract power from the incident electromagnetic beam. A sufficiently small spacing s' also prevents the grid of reflector strips 612 from acting as a diffraction grating that could generate an interfering electromagnetic wave.

Assuming an incident electromagnetic wave I is coupled to the waveguide antenna 400 along a longitudinal path, the diffraction grating formed by the grooves 408 diffracts the incident or longitudinal wave into a diffracted path D radiating out of the plane of the waveguide antenna 400. The diffracted wave has a polarization that is substantially parallel to the axes of the waveguide strips 406, as indicated at $P_D$. The reflector 604 converts the diffracted electromagnetic wave radiated from the waveguide antenna 400 into a reflected beam along a reflected path R, with a polarization of the reflected electromagnetic wave being substantially perpendicular to the axes of the waveguide strips 406, as shown by the arrow $P_R$. As previously discussed, an electromagnetic wave with a polarization substantially perpendicular to the axes of the waveguide strips 406 will pass through the plane of the waveguide 400, which is transparent to a wave so characterized.

The polarization conversion or rotation performed by the reflector 604 occurs by a process well-known in the art. Specifically, the diffracted wave received by the reflector 604 has a polarization in a direction that is 45° relative to the axes of the reflector strips 612. This polarization is formed from two wave components: a first component with polarization parallel to the axes of the reflector strips 612, and a second component with polarization perpendicular to the axes of the reflector strips 612. The first component is reflected from the grid of reflector strips 612, while the second component penetrates the grid and the dielectric layer 606, and is reflected by the metal plate 628. The reflected second component is phase-shifted 180° relative to the first component, whereby the effective polarization sense is rotated 90° relative to the polarization of the diffracted beam received by the reflector. Thus, the reflected beam from the reflector 604 has a polarization that is orthogonal to that of the diffracted beam that impinges on the reflector 604. Furthermore, while the polarization of the reflected beam is still oriented at 45° relative to the axes of the reflector strips 612, its polarization is now perpendicular to the axes of the waveguide strips 406, instead of parallel to the axes as in the diffracted beam prior to impingement on the reflector 604. It will be appreciated that other reflector structures that can perform the requisite change in the sense of polarization as a result of the interaction with the reflector are known in the art, and will suggest themselves to those of ordinary skill in the pertinent arts.

The antenna system 600 employing the reflector 604 allows scanning in first and second planes. Thus, the incident longitudinal beam may be scanned or steered by the scanning antenna element 610 in a first plane, e.g., azimuth, while the reflected beam may be scanned in a second plane, e.g., elevation, since, as discussed above, the reflected beam has a propagation direction and polarization direction that allow it to pass through the plane of the waveguide 400 without interference with the incident longitudinal beam. The scanning in the second plane is accomplished by making the above-described reflector 604 movable. For example, the reflector 604 may be oscillated along an arc 804, thereby changing the angle of the reflected beam from the reflected path R to a selected alternate reflected path R'. As one skilled in the art appreciates, the reflector 604 may be rendered movable, by pivotally mounting the reflector 604 about a pivot (not shown) and use a linear or rotary motor or the like (not shown), to swing the reflector 604 about the pivot. The pivot may be advantageously located at the ends of the reflector 604 or at a location along the length of the reflector 604; for example, about the center of the reflector 604. The movement of the reflector 604 may be controlled manually, or it may be automatically oscillated at a predetermined (fixed or variable) frequency, or it may be oscillated under the control of an appropriately programmed computer (not shown).

As mentioned above, a movable or oscillating reflector 604 in combination with the scanning antenna element 610 previously described can provide beam steering or scanning in two dimensions. For example, the scanning antenna element 610 may provide beam steering about the azimuth plane, and the movable reflector 604 may provide beam steering about the elevation plane.

While the antenna system 600, as described above, employs a rotating diffraction grating drum 620 in the scanning antenna element 610, other types of scanning antenna elements may be employed. For example, the scanning antenna element may be provided by monolithic array of controllable evanescent coupling edge elements, as disclosed in commonly-assigned, co-pending U.S. application Ser. No. 11/956,229, filed Dec. 13, 2007, the disclosure of which is incorporated herein in its entirety. Furthermore, the reflector 604 can be made to oscillate in two orthogonal planes, while the incident beam I may be propagated in a fixed (non-scanning) direction. In such an embodiment, the antenna described above with reference to FIGS. 4 and 5 would function merely as a feed "horn" for the moving reflector.

Although the present disclosure has been described with reference to specific embodiments, these embodiments are illustrative only and not limiting. Furthermore, many variations and modifications of the embodiments described herein may suggest themselves to those of ordinary skill in the pertinent arts. For example, the use of "top" and "bottom" to refer to the opposite surfaces of the dielectric substrate or slab is for convenience only in this disclosure, it being understood that the diffraction grating and the conductive grid of metal strips must be provided on opposite surfaces of the dielectric substrate, and the substrate surfaces that are the "top" and "bottom" surfaces, respectively, while depend on the particular orientation of the apparatus. By way of further example, and without limitation, the diffraction grating, scanning antenna element, and reflector employed in the antenna systems described above may be of various types, well-known in the art, without departing from the disclosure herein. These and other variations and modifications may be considered to be within the range of equivalents to the disclosed embodiments, and thus to be within the spirit and scope of this disclosure.

What is claimed is:

1. A dielectric waveguide, comprising:

a dielectric substrate having first and second opposed surfaces defining a longitudinal wave propagation path therebetween; and a conductive grid on the first surface of the dielectric substrate and comprising a plurality of substantially parallel metal strips, each defining an axis, wherein each of the metal strips has a centerline, and wherein the centerlines of two adjacent metal strips are separated by a spacing s that is given by the formula $s<\lambda/(1+\beta/k)$, where $\beta$ is the wave propagation constant in the dielectric substrate, k is the wave vector in a vacuum, and $\lambda$ is the wavelength of an electromagnetic wave propagating through the dielectric substrate along the longitudinal wave propagation path with a defined polarization, whereby the axes of the metal strips in the grid are substantially parallel to the defined polarization of the electromagnetic wave, so as to render the first surface of the dielectric substrate opaque to the electromagnetic wave.

2. The waveguide of claim 1, wherein s is at least approximately $\lambda/10$.

3. The waveguide of claim 1, wherein the axes of the strips are substantially normal to the longitudinal wave propagation path.

4. The waveguide of claim 1, wherein the grid also renders the first surface of the substrate substantially transparent to a transverse electromagnetic wave propagating along a transverse propagation path that intersects the first and second surfaces of the substrate, the transverse wave having a polarization direction substantially normal to the axes of the metal strips.

5. The waveguide of claim 4, further comprising a dielectric reinforcing plate disposed in contact with metal strips, whereby the metal strips are disposed between the substrate and the reinforcing plate.

6. The waveguide of claim 5, wherein the dielectric reinforcing plate is configured to support anti-reflective conditions for the transverse electromagnetic wave.

7. A dielectric waveguide antenna, comprising:

a dielectric substrate having first and second opposed surfaces defining a longitudinal wave propagation path therebetween;

a conductive grid on the first surface of the substrate and comprising a plurality of substantially parallel metal strips, each defining an axis, wherein each of the metal strips has a centerline, wherein the centerlines of two adjacent metal strips are separated by a spacing s, and wherein the spacing s is given by the formula $s<\lambda/(1+\beta/k)$, where $\beta$ is the wave propagation constant in the dielectric substrate, k is the wave vector in a vacuum, and $\lambda$ is the wavelength of an electromagnetic wave propagating through the substrate, whereby the grid renders the first surface of the substrate opaque to a longitudinal electromagnetic wave propagating through the substrate along the longitudinal wave propagation path and having a polarization direction substantially parallel to the axes of the strips, while the grid also renders the first surface of the substrate substantially transparent to a transverse electromagnetic wave propagating along a transverse propagation path that intersects the first and second surfaces of the substrate, the transverse wave having a polarization direction substantially normal to the axes of the metal strips, the substrate and the grid forming a waveguide; and a diffraction grating on the second surface of the substrate.

8. The antenna of claim 7, wherein s is at least approximately $\lambda/10$.

9. The antenna of claim 7, wherein the axes of the strips are substantially normal the longitudinal propagation path.

10. The antenna of claim 7, further comprising a dielectric reinforcing plate disposed in contact with metal strips, whereby the metal strips are disposed between the substrate and the reinforcing plate.

11. The antenna of claim 10, wherein the dielectric reinforcing plate is configured to support anti-reflective conditions for the transverse electromagnetic wave.

12. The antenna of claim 7, wherein the diffraction grating comprises a pattern of grooves in the second surface.

13. The antenna of claim 7, wherein the diffraction grating comprises a pattern of conductive elements on the second surface.

* * * * *